US005477882A

United States Patent [19]

Duthie

[11] Patent Number: 5,477,882

[45] Date of Patent: Dec. 26, 1995

[54] HYDRAULIC SYSTEMS

[75] Inventor: Anthony J. Duthie, Horsham, United Kingdom

[73] Assignee: Johnston Engineering Limited, Dorking, United Kingdom

[21] Appl. No.: 220,221

[22] Filed: Mar. 30, 1994

[30] Foreign Application Priority Data

Apr. 2, 1993 [GB] United Kingdom ..... 9306906

[51] Int. Cl.[6] ..... F15B 11/17

[52] U.S. Cl. ..... 137/567; 60/478; 60/486

[58] Field of Search ..... 137/567; 60/478, 60/486

[56] References Cited

U.S. PATENT DOCUMENTS

| | | | |
|---|---|---|---|
| 2,830,668 | 4/1958 | Gaubis et al. | 60/478 X |
| 3,130,548 | 4/1964 | Hunt | 60/478 |
| 3,331,445 | 7/1967 | Currie | 137/567 X |
| 4,799,864 | 1/1989 | Hockley | 137/567 X |
| 4,835,968 | 6/1989 | Yamaguchi | 60/486 X |

FOREIGN PATENT DOCUMENTS

| | | |
|---|---|---|
| 2711137 | 9/1978 | Germany . |
| 1550590 | 8/1979 | United Kingdom . |

*Primary Examiner*—John Rivell
*Attorney, Agent, or Firm*—Young & Thompson

[57] ABSTRACT

A hydraulic system 10 provides a positive supply of hydraulic fluid at a controlled pressure to plurality of pumps. The system comprises a fluid reservoir 15 having outlet means to supply fluid to an auxiliary pump 30. A pressure chamber 16 communicates with a reservoir 15 and has outlet means to supply fluid to a plurality of working pumps 11, 12, 13. An inlet manifold 18 is provided for receiving fluid returned from the working and auxiliary pumps.

3 Claims, 1 Drawing Sheet

HYDRAULIC SYSTEMS

The invention relates to improvements in hydraulic systems and in particular to a system for providing a positive flow of hydraulic fluid to a number of open-loop hydraulic pumps.

Many mobile machines, such as road sweeping machines, utilise hydraulic pumps for various duties. These duties can include propelling the vehicle via a hydrostatic transmission system, driving an exhauster fan with a hydraulic motor to generate the suction source for collecting debris, hydraulic drives for other apparatus such as brushes, water pumps, cylindrical actuators and so on. A feature often required of such mobile machines is that they are expected to work on various climatic conditions, from the hottest day in summer to the coldest day in winter without any adjustments having to be made.

Where the hydraulic pumps are "open-loop" pumps, the pumps usually draw their oil directly from a reservoir which is used to pressurise the working circuit with the hydraulic fluid being returned to the reservoir via some sort of filter prior to recirculation. To serve the pump with fluid, the suction line, associated connections, isolation valves and so on need to be of suitably large proportions to ensure that cavitation does not occur in cold conditions or on initial start-up at the beginning of a working shift when the fluid is cold and naturally more viscous. This has the disadvantage that the pipework and associated equipment are generally larger than needed once the system has warmed up, which means an increase in weight of the apparatus and the cost. The positioning of the reservoir relative to the pumps is also fairly critical to ensure that positive pressure is provided to the pumps.

It is therefore an object of the present invention to provide a hydraulic system which provides a positive supply of fluid at a controlled pressure which is sensitive to the viscosity of the oil and which overcomes these disadvantages.

According to the invention there is therefore provided a hydraulic system for providing a positive supply of hydraulic fluid at a controlled pressure to a plurality of pumps, comprising a fluid reservoir; said fluid reservoir having outlet means to supply fluid to an auxiliary pump; a pressure chamber communicating with said reservoir; said pressure chamber having outlet means to supply fluid to a plurality of working pumps, and inlet means for receiving fluid returned from the working and auxiliary pumps.

Figure 1:
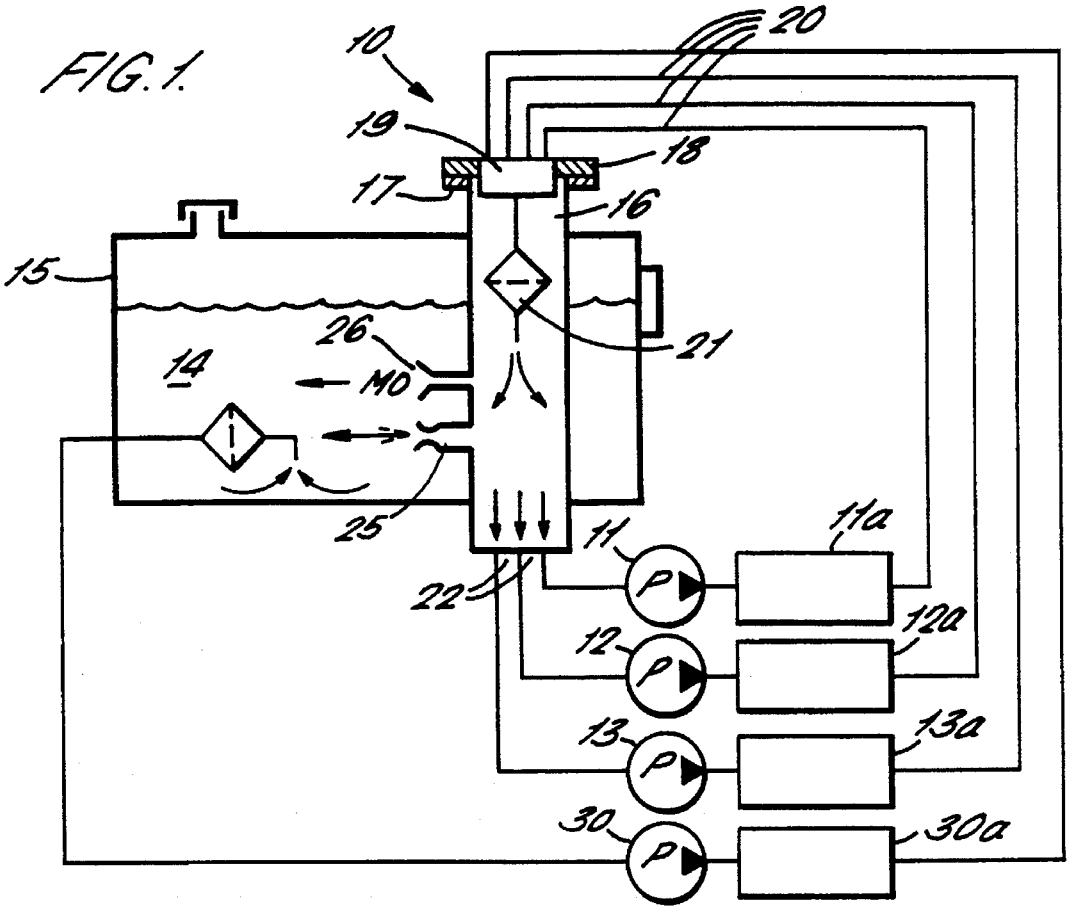
Figure 2:
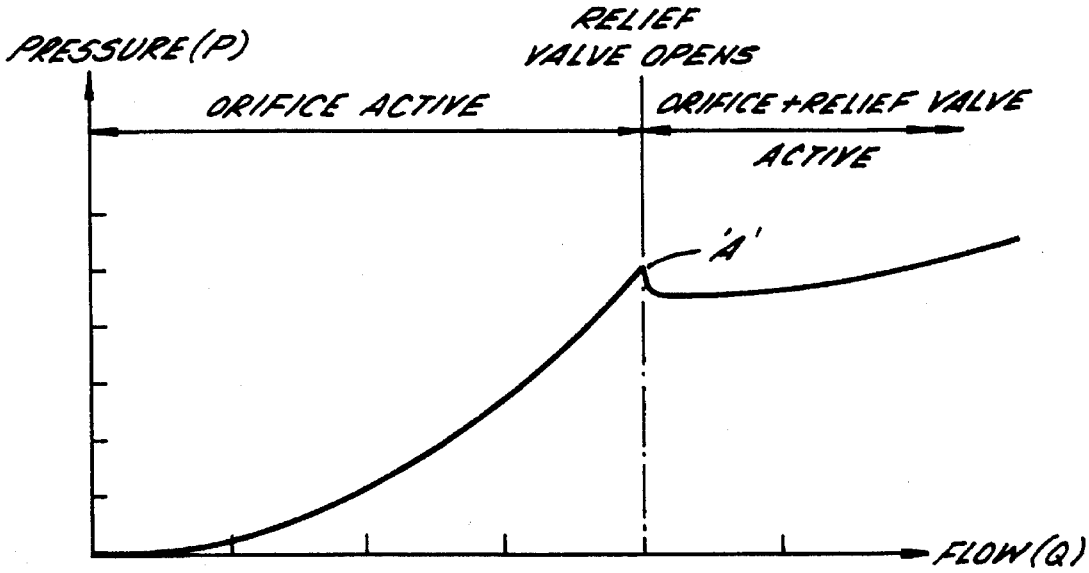

A preferred embodiment of the invention will now be described, by way of example only, with reference to the accompanying drawings in which:

FIG. 1 is a schematic representation of a hydraulic system according to the invention; and FIG. 2 is a graphical representation of the pressure characteristics of the invention of FIG. 1.

Referring to FIG. 1, there is provided a hydraulic system 10 comprising three open-loop hydraulic pumps 11, 12, 13. The three pumps 11, 12, 13 serve respectively working circuits 11*a*, 12*a*, 13*a* which can include appartus and drives having any functions required.

The pumps 11, 12, 13 are supplied with hydraulic fluid 14 which is stored in a central reservoir 15. Integrated into the central reservoir is a pressure canister 16 which is in a generally cylindrical shape and has an open flange 17 at one end thereof. Bolted onto the open flange 17 is a ceiling manifold 18 which provides connections 19 for the return lines 20 from the working circuits 11*a*, 12*a*, 13*a*.

Inside the pressure canister 16 is a fine micronic filter 21 which filters the fluid returning from the working circuits.

At the opposite end of the canister 16 to the manifold 18 are provided means 22 for connecting the inlet of the pumps 11, 12, 13.

The pressure canister draws hydraulic fluid direct from the reservoir 15 via orifice 25. There is also a relief valve 26 which allows the pressure canister 16 to vent to the main reservoir at a certain preset pressure.

The system 10 also has an auxiliary pump 30, which may also supply a working circuit 30*a*. Pump 30 draws it working fluid directly from a main reservoir 15, rather than the pressure canister 16, but returns it to the pressure canister 16. The result is that pumps 11, 12, 13 are provided with a "boosted" inlet flow from the canister 16. The boost pressure created within the canister 16 is generated by the condition where the returning fluid to the canister 16 is of a greater volume than the output flow to the pump 11, 12, 13. The relief valve, set for example at one bar, enables any excess oil to be vented directly to the reservoir over the preset pressure.

The orifice 25 helps to provide thermal control related to oil temperature or viscosity. For instance when the oil is cold and more viscous, the boost pressure is at the one bar setting as the relief valves would be active. As the fluid warms up and becomes less viscous, the boost pressure will drop due to the relief valve closing with the orifice 25 solely providing the pressure influence. With an auxiliary flow of approximately 35 liters per minute, the orifice would normally be 5 mm in diameter.

The hydraulic pressure control system 10 can thus compensate for pressure drop characteristics that can result from viscosity changes in the connections or pipework to the pumps, i.e., higher viscosity results in a higher boost pressure, whereas lower viscosity results in a lower boost pressure. This feature can be applied to a system where the pressure criteria of the actual pumps inlet port would be constant, regardless of what the viscosity index of the fluid is.

The orifice outlet 25 being submerced within the fluid in a main reservoir 15 also provides another function in that it allows the booster pumps during their initial priming process on first start-up to draw oil from the reservoir via this orifice.

FIG. 2 shows the boost pressure characteristics generated by the combination of the orifice and relief valve 26 with the peak value 'A' being the relief valve setting value.

The invention therefore provides a system where a positive supply of hydraulic fluid can always be fed to the main circuit pumps at a controlled pressure; the system is sensitive to the viscosity of oil; the pipework proportions can be smaller due to a positive pressure influence, thus saving weight and cost; the positioning of the reservoir relative to the booster pumps is less critical with regard to being above or below the pumps, or its distance from them due to the possibility of a positive pressure influence.

I claim:

1. A hydraulic system for providing a positive supply of hydraulic fluid at a controlled pressure to a plurality of pumps, comprising a fluid reservoir; said fluid reservoir having outlet means to supply fluid to an auxiliary pump; a pressure chamber having an orifice communicating with said reservoir by means of which fluid can flow in both directions between the reservoir and pressure chamber; said pressure chamber having outlet means to supply fluid to a plurality of working pumps, inlet means for receiving all the hydraulic fluid returned from the working and auxiliary pumps, and a pressure relief valve, set at a predetermined pressure setting, allowing the chamber to also vent fluid above the predetermined pressure to the reservoir.

2. A hydraulic system as claimed in claim 1 further comprising a plurality of open-loop working pumps connected to the outlet and inlet means of the pressure chamber.

3. A hydraulic system as claimed in claim 1 further comprising an open-loop auxiliary pump connected to the outlet means of the fluid reservoir and the inlet means of the pressure chamber.

* * * * *